US008752485B2

(12) United States Patent
Muller et al.

(10) Patent No.: US 8,752,485 B2
(45) Date of Patent: Jun. 17, 2014

(54) RE-LOCKING DEVICE FOR A ROCKER ARM DETONATOR

(75) Inventors: Christian Johann Muller, Magdeburg (DE); Klaus Basse, Quedlinburg (DE); Ilka Bosse, Neudorf (DE); Wolfgang Schutzendubel, Ermsleben (DE); Gabriele Wetzel, Dankerode (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 488 days.

(21) Appl. No.: 13/117,456

(22) Filed: May 27, 2011

(65) Prior Publication Data

US 2011/0290144 A1 Dec. 1, 2011

Related U.S. Application Data

(60) Provisional application No. 61/408,368, filed on Oct. 29, 2010.

(30) Foreign Application Priority Data

May 27, 2010 (DE) ..... 10 2010 021 685

(51) Int. Cl.
*F42B 27/08* (2006.01)

(52) U.S. Cl.
USPC ..... 102/482; 102/221; 89/27.12

(58) Field of Classification Search
USPC ..... 102/482, 487, 499, 368, 221; 89/27.12
See application file for complete search history.

(56) References Cited

U.S. PATENT DOCUMENTS

| | | | | | |
|---|---|---|---|---|---|
| 2,437,001 | A | | 3/1948 | Petersen | |
| 3,498,223 | A | | 3/1970 | Andersson et al. | |
| 3,742,855 | A | * | 7/1973 | Webb | 102/487 |
| 3,765,337 | A | * | 10/1973 | Padula | 102/487 |
| 4,135,451 | A | * | 1/1979 | Rusbach | 102/487 |
| 4,513,667 | A | | 4/1985 | Caruso | |
| 4,926,752 | A | * | 5/1990 | DiRubbio et al. | 102/486 |
| 5,196,649 | A | * | 3/1993 | DiRubbio et al. | 102/486 |
| 5,886,288 | A | * | 3/1999 | Brunn | 102/482 |
| 6,792,868 | B2 | | 9/2004 | Teilhol et al. | |
| 7,197,983 | B2 | * | 4/2007 | Barth et al. | 102/487 |
| 8,561,540 | B1 | * | 10/2013 | Lauch | 102/258 |
| 2006/0283346 | A1 | | 12/2006 | Luebbers et al. | |

FOREIGN PATENT DOCUMENTS

| | | | |
|---|---|---|---|
| BE | 505324 | A | 9/1951 |
| CH | 379966 | A | 7/1964 |
| DE | 23 30 189 | A1 | 1/1975 |
| DE | 202005009628 | U1 | 10/2005 |
| FR | 601 185 | A | 2/1926 |
| FR | 625 278 | A | 8/1927 |
| FR | 628 604 | A | 10/1927 |
| FR | 799 440 | A | 6/1936 |
| FR | 2 432 153 | A1 | 2/1980 |
| FR | 2 500 621 | A1 | 8/1982 |

* cited by examiner

*Primary Examiner* — Benjamin P Lee
(74) *Attorney, Agent, or Firm* — Griffin & Szipl, P.C.

(57) ABSTRACT

A re-locking device for a rocker arm detonator (1) of an armament, such as a hand grenade, irritation body etc., is formed by a security mechanism (3), which facilitates a repeat locking after activation of the armament. The re-locking device includes at least one profile part (4, 4'), which is pivotably arranged and able to engage with the armament by means of an expedient (9), especially with the ignition head (5, 5') and the rocker arm (2).

16 Claims, 5 Drawing Sheets

RE-LOCKING DEVICE FOR A ROCKER ARM DETONATOR

This application claims priority from U.S. Provisional Patent Application No. 61/408,368, filed Oct. 29, 2010 and on German Patent Application No. DE 10 2010 021 685.2, filed on May 27, 2010, the entire disclosures of which are incorporated herein by reference.

FIELD OF THE INVENTION

The present invention concerns a so-called "re-locking device" for a rocker arm detonator of an armament, for example, a hand grenade, an irritation body, and similar items.

BACKGROUND OF THE INVENTION

Manually launched armaments of this type with time-delayed pyrotechnical detonation frequently have a rocker arm mechanism. It is blocked for durable locking by a bolt (pin). The rocker arm arrests a firing pin mechanism. If the rocker arm detaches itself, the firing pin triggers the pyrotechnical ignition chain, resulting in time-delayed action (e.g., explosion, combustion, etc.). In general application, the operator grasps the armament and the rocker arm with one hand so that, after removal of the safety pin, the operator presses the freely movable rocker arm against the armament. If the armament is tossed, the rocker arm separates from the armament and the ignition mechanism is activated.

In the event that the operator during the interval between removal of safety pin and launching the armament decides against throwing the armament, he needs to again grasp the armament for re-locking. Re-locking can then take place by inserting the safety bolt back into the rocker arm mechanism, which, on the one hand, is not only difficult, but, on the other hand also requires at least two hands. If the person or the operator finds himself additionally in a stressful situation, or if the person/operator wears gloves, such re-locking by replacing the safety pin is difficult.

A time igniter for explosives, namely a hand grenade, is known from DE 23 30 189A, in which a piston activated by a pressure spring slides downward in a closed cylinder, whose downward movement begins at the moment when the ignition mechanism is released, and whose speed is determined by pneumatic equalization. In spite of comments to the effect that once it has been activated, and made ready to be tossed, the time igniter must be restored to a safe transport state, no further explanations are provided on the subject.

Additional rocker arms are described in BE 50 53 24, FR 625 278, FR 799 440, FR 2 432 153, FR 2 500 621, as well as FR 601 185, which deal in part with re-locking. Moreover, a hand grenade with delayed ignition can be gathered from CH 379 966 A5. The specification of CH 379 966 A5 distinguishes itself in that the firing device and the ignition delay element with detonator are arranged in one line of action to each other. In the secured state of the hand grenade, the transfer element lies outside the line of action. As a result, it is only during a second phase that the slider is released for execution of a movement. A safety rod serves for this purpose, which has axially been shifted within the slider during the first phase. If de-activation of the live status of the hand grenade is required, due to special circumstances, then the safety rod is left in the position of the first phase, so that the time-delay set will, in fact, burn through and the detonator will be ignited, but the explosive set, itself, will not be included. In this case, we are not so much dealing with a re-locking mechanism but rather with a potential safety means for the aversion of risk.

It is the object of the present invention to provide a re-locking mechanism of a projectile following activation and/or detachment of the rocker arm employed for that purpose.

SUMMARY OF THE INVENTION

Means for attaining the object of the invention are the characteristics of a first embodiment, which pertains to a rocker arm detonator (1) with an ignition head (5, 5') and a rocker arm (2) for an armament with ignition housing, characterized in that a safety mechanism (3) is integrated, which facilitates re-securing after arming of the armament, comprising at least one profile component (4, 4'), which is pivotably arranged and able to engage with a means (9) with the armament. Beneficial additional embodiments of the invention are outlined as follows.

In accordance with a second embodiment of the present invention, the first embodiment is modified so that the engagement occurs specifically in the ignition head (5, 5') and the rocker arm (2). In accordance with a third embodiment of the present invention, the first embodiment and the second embodiment are further modified so that the profile part (4, 4') is integrated between the ignition housing and the ignition head (5, 5') and is held in position by the ignition head (5, 5'). In accordance with a fourth embodiment of the present invention, the first embodiment, the second embodiment, and the third embodiment are further modified so that the rocker arm detonator (1) is activated by removal of a safety pin (13) and rotation of the profile part (4, 4') in position is only possible in the direction of a locked position.

In accordance with a fifth embodiment of the present invention, the first embodiment, the second embodiment, the third embodiment and the fourth embodiment are further modified so that the profile part (4, 4') has a special profile (11, 16), which prevents the disengagement of the locked position. In accordance with a sixth embodiment of the present invention, the fifth embodiment is further modified so that the profile (11) has the form of a ratchet profile, which functionally interacts with a cross piece (12) located at the ignition head (5) in such a manner that, with turning of the profile part (4) against a resistance beyond a critical position, the cross piece (12) snaps into the locked position at the profile part (4). In accordance with a seventh embodiment of the present invention, the fifth embodiment is modified so that the profile (16) has the shape of an oblique edge, which functionally interacts with a profiling or profiling member (15) integrated at the ignition head (5'). In accordance with an eighth embodiment of the present invention, the fourth embodiment, the fifth embodiment, the sixth embodiment, and the seventh embodiment are further modified so that while the safety pin (13) secures the system, the rocker arm (2) is off-set vis-à-vis the effective agent (9) of the safety disc (4, 4') in that penetration of the effective agent (9) into the recesses (6, 7) is not possible, but only with disengagement of the safety pin (13) and a change in position of the rocker arm (2).

In accordance with a ninth embodiment of the invention, an armament is provided that includes: (a) an ignition housing; (b) a rocker arm detonator provided with an ignition head and a rocker arm, wherein the rocker arm detonator is attached to the ignition housing; and (c) a safety mechanism integrated with the rocker arm detonator, wherein the safety mechanism facilitates re-securing of the rocker arm detonator after arming of the armament in order to arrest detonation of the armament, and wherein the safety mechanism comprises at least one profile component that is pivotably arranged on the ignition housing and that includes a safety cone that pivots with the at least one profile component to engage with the rocker arm of the armament, wherein the safety cone pivots with the at least one profile component to engage both the ignition head and the rocker arm, wherein the safety cone protrudes in an upward direction from the at least one profile component so that the safety cone is arranged directionally.

More generally, the invention is based on the idea of creating a preferably permanent re-locking mechanism (i.e., a safety mechanism), which is independent of the safety pin and by means of which it is possible to forego installation aids that facilitate the re-insertion of the safety pin. To that end, the re-locking mechanism consists of a molded part, which is rotatably connected with the armament. The molded part has a bolt and/or pin etc., in other words an "effective means" that can engage with a recess in the rocker arm and armament housing, i.e., engage between the rocker arm and the a striker piece as well as the armament housing. Thus, both the rocker arm detonator and the striker piece are arrested by a profile piece. The safety mechanism preferably has an additional profile, which prevents disengagement in a locked position. The profile is, for example, a ratchet profile at the profile component, which functionally interacts with another means at the armament. An alternative solution, however, is also inclusion of an oblique edge in the profile of the ignition head.

In order to trigger the re-locking mechanism, the profile part is turned in such a manner that the locking means enters into the recess of the rocker arm and, thus, restricts the mobility of the rocker arm so that triggering is no longer possible. The rocker arm detonator is arranged, at the same time, under the striker piece so that it cannot move. The ratchet mechanism and/or the edge, in turn, prevent repeat detachment of the rotary component, or profile part from the recess, thereby averting a renewed activation.

If, however, repeat activation and re-locking is to be facilitated, it is possible to forego a profile of this form and to perhaps resort to a profile that is known in connection with ball point pens.

The proposed safety mechanism thus acts independently from the safety bolt (safety pin). Triggering of the supplemental safety mechanism of the present invention is easily done, is permanent, and can be designed to be irreversible. Another benefit, in accordance with the present invention, is that the safety mechanism can be operated with one hand, and even if the operator is wearing gloves or similar equipment.

BRIEF DESCRIPTION OF THE DRAWINGS

The invention will be explained in more detail using an exemplary embodiment and drawings. The drawings depict the following.

DETAILED DESCRIPTION OF THE INVENTION

Figure 1:
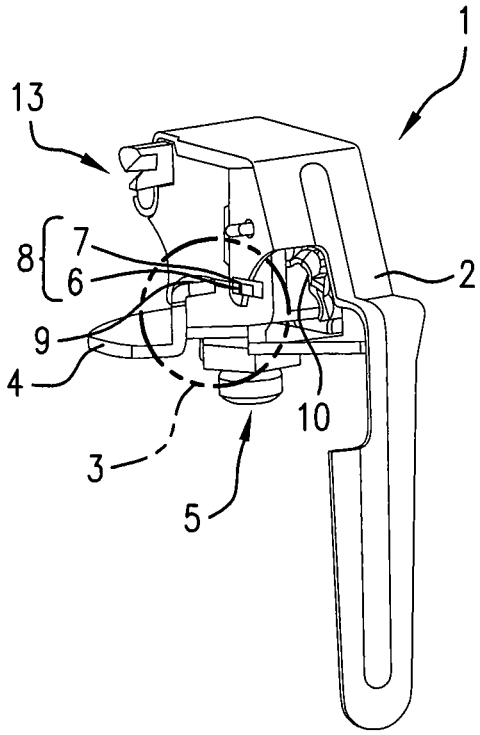
FIG. 1 illustrates a rocker arm with attached safety mechanism in accordance with the present invention.
Figure 3:
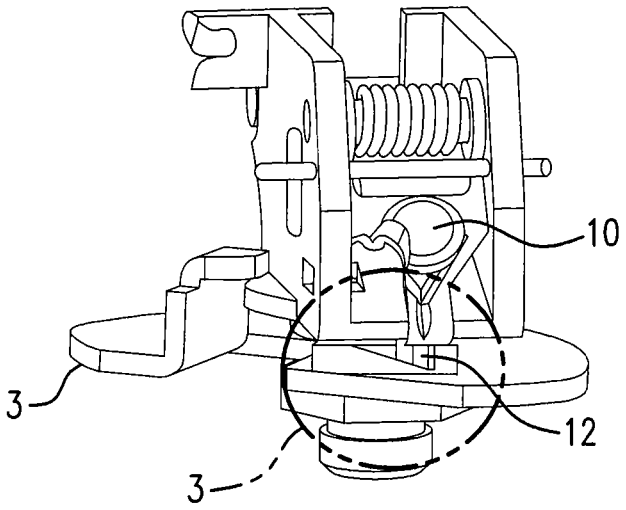
FIG. 3 is an enlarged representation of the ignition head without the rocker arm.

FIG. 1 represents, in its essential parts, a rocker arm detonator 1 with rocker arm 2 (partially refracted) and a safety mechanism 3. A striker piece 10, functionally cooperating with the rocker arm 2, is part of the rocker arm detonator 1. The safety mechanism 3 consists of a profile component 4 (molded part) as a safety disc of the safety mechanism 3 and a modified ignition head 5, which is a component of the rocker arm detonator 1. The ignition head 5 is attachable to an ignition housing of an armament (not shown in more detail in FIG. 1), for example, by screw attachment. Integration of safety disc 4 (4') between the ignition housing and the ignition head 5 is done in such manner that it is arranged pivotably around the main axis and held in place by ignition head 5 (FIG. 3).

At the ignition head 5 (5'), as well as at the rocker arm 2, there is respectively provided a first and second recess 6, 7, which constitute a safety slot 8. The profile part 4 (FIG. 4) presents a bolt 9 as safety bolt (or a safety cone), which can be pushed by turning disc 4 into the safety slot 8 of the rocker arm detonator 1 or the ignition head 5. By means of this insertion of the safety bolt or safety cone 9, the rocker arm 2 as well as the striker piece 10 are arrested independently of the safety pin 13, and, as a result, are again lockable or re-securable (FIG. 1).

Figure 2:
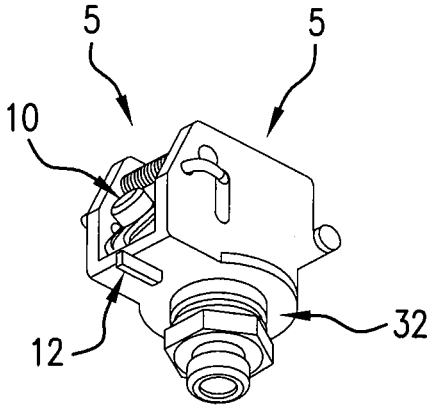
FIG. 2 is a representation of FIG. 1 without the rocker arm.
Figure 4:
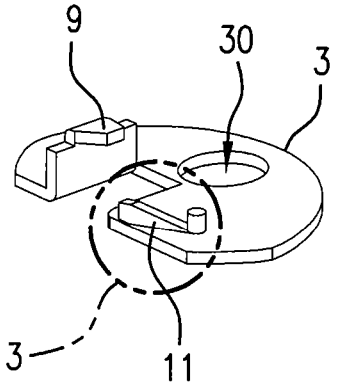
FIG. 4 is an enlarged representation of the safety disc from FIG. 3.
Figure 5A:
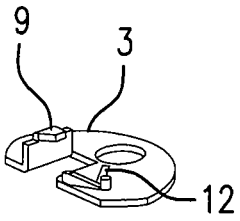
FIG. 5 is an enlarged representation of the ratchet block from FIG. 3 at rest (a) and in locked position (b)
Figure 5B:
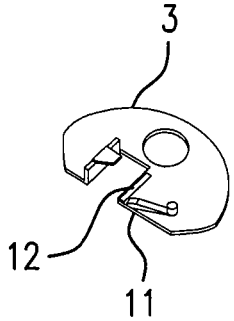

With respect to the restricted rotational movement of the safety disc 4, the disc additionally has a special profile 11, which was created in this case in the form of a ratchet profile (FIG. 4). At the ignition head 5 is located a cross piece 12 (FIG. 2), which interacts with ratchet profile 11 (FIG. 3). The cross piece 12 lies in operationally ready status in rest position (FIG. 5*a*). In this rest position, the rocker arm detonator (1) can be activated by removal of the safety pin 13. Rotation of the turning disc 4 in this position is only possible in the direction of the locked position (FIG. 5*b*). This creates a resistance against the rotation, which prevents accidental locking. If disc 4 is turned against the resistance beyond a critical position, cross piece 12 comes to rest in a locked position. The safety system is active in this configuration, with the ratchet profile 11 preventing disengagement from the locked position. In this case, locking is irreversible.

Figure 6:
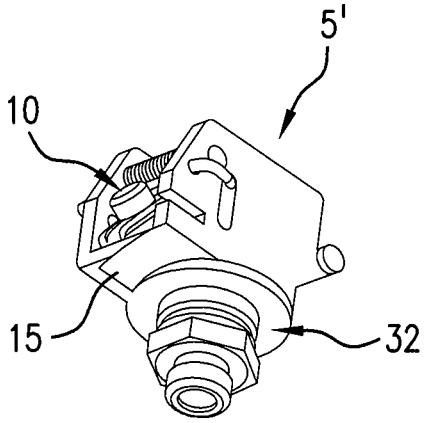
FIG. 6 is a representation from FIG. 1 without the rocker arm, similar to FIG. 2.
Figure 7:
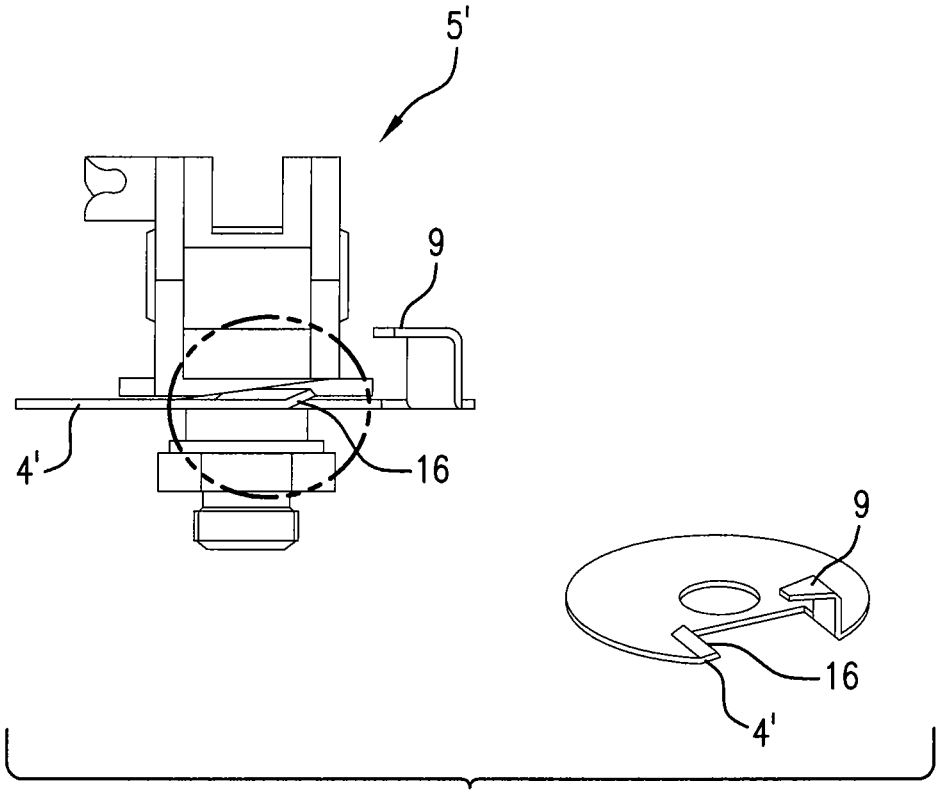
FIG. 7 is a representation of the ignition head and the safety disc from FIG. 8 in the rest position.
Figure 8:
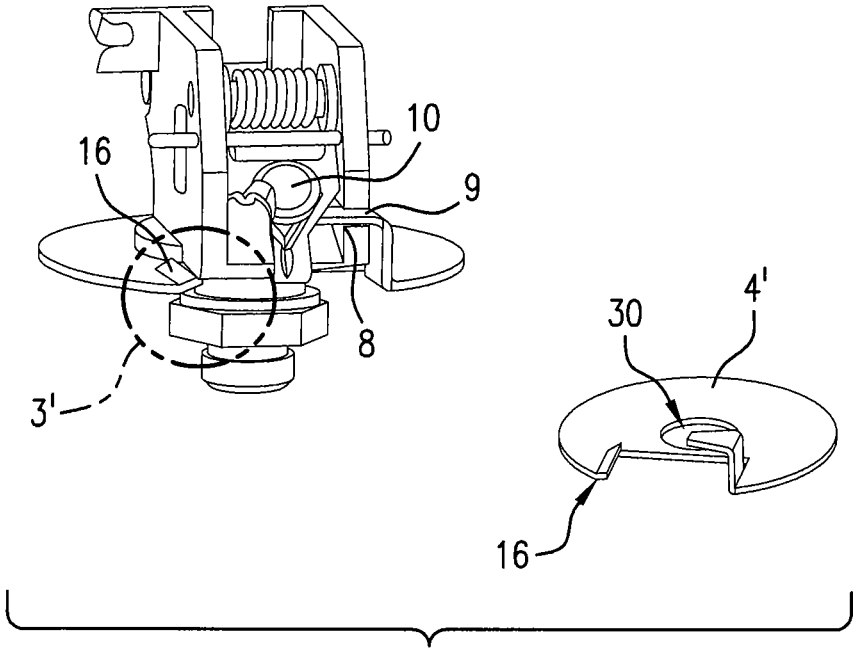
FIG. 8 is a representation of the ignition head and the safety disc from FIG. 6 in a locked position.

FIG. 6 depicts another modified ignition head 5' provided with a connection link guide 15, which cooperates with a profile 16 of another safety disc 4' embodiment. Disc 4' shows, in this case, an oblique edge 16, which, together with profiling or profile member 15 constitutes the locking mechanism 3'. The molded part 4' has two distinctive positions. FIG. 7 depicts the position of the safety disc 4' in unsecured status, and FIG. 8 depicts the position of the safety disc 4' in secured status. If locking is activated, in other words, if the disc 4' is turned, a mechanical tension is generated by the oblique edge, which offers resistance to the rotation. The rotation is reversibly possible until the second distinctive position of the safeguard is reached, namely, the secure position. The disc 4' is turned to the extent so that the effective means 9 (i.e., the bolt) is located in the recesses 6, 7 (i.e., safety slot 8) at the rocker arm 2 and ignition head 5'. The oblique edge 16 at disc 4' is pushed over the ignition body housing edge by the mechanical tension and thereby blocks any turning back to the unsecured status (i.e., FIG. 7).

For prevention of locking while safety pin 13 is still in place, and for prevention of accidental triggering, which would render its use no longer possible, the suggestion may be offered that the rocker arm 2 will always be held in a 'fixed" position, as long as the safety pin 13 is present is the armament system and that only with disengagement of the safety pin 13 can the position of the rocker arm 2 readily be changed. In other words, while the safety pin 13 secures the armament system, the pin retains the rocker arm 2 plus the striker piece 10 in its fixed position. As a result of the safety mechanism, the rocker arm 2 remains off-set in such a manner vis-à-vis the effective agent 9 of the safety disc 4, 4', that penetration of effective agent 9 into the slot 8 is not possible, but it is only possible with detachment of the safety pin 13 and a position change of rocker arm 2. In other words, in accordance with this particular embodiment, the rocker arm 2 is off-set by the bolt 9 so that penetration of the slot 8 is not possible until after detachment of the safety pin 13 and a position change of the rocker arm 2, after which it is possible to rotate the safety disc 4, 4' so that the bolt 9 penetrates the slot 8.

Figure 9:
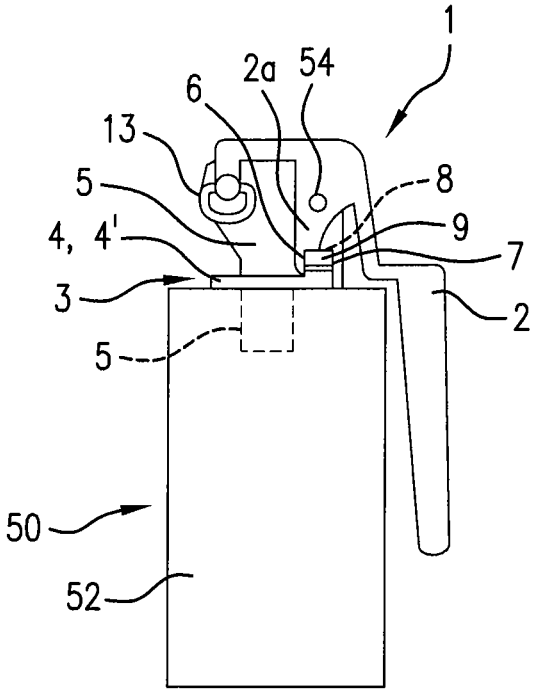
FIG. 9 illustrates schematically an armament, in accordance with the present invention, that is equipped with the rocker arm detonator with attached safety mechanism.

FIG. 9 depicts an armament 50 that has an ignition housing 52, and which is provided with the rocker arm detonator 1 with the ignition head 5, 5' and a rocker arm 2 that is rockable about pivot 54 when the pin 13 has been removed, characterized in that the armament 50 is provided with a safety mechanism 3 integrated in the armament 50. The safety mechanism 3 facilitates re-securing of the rocker arm detonator 1, after arming of the armament by removing the pin 13. The safety mechanism 3 includes at least one profile component 4, 4', which is pivotably arranged to pivot on the ignition housing 52 and which is able to engage with a slot 8 by means of a bolt 9. When the bolt 9, which forms a portion of the profile component 4, 4', is engaged in the slot 8, the rocker arm 2 is secured in a fixed position (i.e., the rocker arm 2 is not free to pivot about the pivot 54) because a portion of the slot 8 is formed, in part, by a recess 6 formed in a portion 2*a* of the rocker arm 2, and the slot 8 is formed in part by a recess 7 formed in ignition head 5. In this way, when the profile component 4, 4' has been rotated on the ignition housing 52 so that the bolt 9 is engaged in the slot 8, the bolt 9 engages recesses 6 and 7 so as to maintain the rocker arm 2 in the fixed position as shown in FIG. 9. As evident from FIG. 9, the armament 50 may be a hand grenade, an irritation body, and the like. In addition, as evident from FIGS. 1, 2, 4 and 8, the at least one profile component 4, 4' includes a circular hole 30 formed therethrough, and wherein ignition head 5, 5' is provided with a cylindrical mounting portion 32 that penetrates through the circular hole 30 of the at least one profile component 4, 4' so that the at least one profile component 4, 4' is mounted to pivot on the cylindrical mounting portion 32 of the ignition head 5, 5'.

The invention claimed is:

1. An armament comprising:

(a) an ignition housing;

(b) a rocker arm detonator provided with an ignition head and a rocker arm, wherein the rocker arm detonator is attached to the ignition housing; and (c) a safety mechanism integrated with the rocker arm detonator, wherein the safety mechanism facilitates re-securing of the rocker arm detonator after arming of the armament in order to arrest detonation of the armament, and wherein the safety mechanism comprises at least one profile component that is pivotably arranged on the ignition housing and that includes a bolt means that pivots with the at least one profile component to engage with the rocker arm of the armament, wherein the bolt means pivots with the at least one profile component to engage both the ignition head and the rocker arm.

2. An armament according to claim 1, wherein the at least one profile component is integrated between the ignition housing and the ignition head and is held in position by the ignition head.

3. An armament according to claim 2, wherein the rocker arm detonator is activated by removal of a safety pin, and rotation of the at least one profile component in position is only possible in a direction of a locked position.

4. An armament according to claim 1, wherein the rocker arm detonator is activated by removal of a safety pin, and rotation of the at least one profile component position is only possible a direction of a locked position.

5. An armament according to claim 4, wherein while the safety pin secures the rocket arm detonator, the rocker arm is off-set vis-à-vis the bolt means of the at least one profile component so that penetration of the bolt means into a slot formed in the rocker arm detonator is not possible, but only with -disengagement of the safety pin and a change in position of the rocker arm is it possible for the bolt means to penetrate the slot formed in the rocker arm detonator.

6. An armament according to claim 5, wherein the slot formed in the rocker arm detonator is partially formed by a first recess formed in the rocker arm and partially formed by a second recess formed in the ignition head.

7. An armament according to claim 6, wherein the at least one profile component includes a circular hole formed therethrough, and wherein the ignition head is provided with a cylindrical mounting portion that penetrates through the circular hole of the at least one profile component so that the at least one profile component is mounted to pivot on the cylindrical mounting portion of the ignition head.

8. An armament according to claim 4, wherein the at least one profile component has a special profile that prevents disengagement of the locked position.

9. An armament according to claim 8, wherein the special profile has the shape of an oblique edge that functionally interacts with a profiling portion integrated at the ignition head.

10. An armament according to claim 8, wherein the special profile has the form of a ratchet profile that functionally interacts with a cross piece located at the ignition head so that, with turning of the at least one profile component against a resistance beyond a critical position, the cross piece snaps into the locked position at the at least one profile component.

11. An armament according to claim 1, further comprising:

(d) a striker piece disposed on the ignition head; and (e) a safety pin attached to the ignition head in a detachable manner, wherein the ignition head, the rocker arm detonator, the striker piece, and the safety pin form an effective body.

12. An armament according to claim 11, wherein the at least one profile component is pushable into a safety slot, wherein the safety slot is formed in the rocker arm detonator or in the ignition head of the rocker arm detonator, and wherein when the at least one profile component is pushed into the safety slot, then the rocker arm and the striker piece are arrested independent of the safety pin so that the rocker arm and the striker piece are again re-securable to arrest detonation of the armament.

13. An armament according to claim 11, wherein the rocker arm detonator is activated by removal of the safety pin, and rotation of the at least one profile component in position is only possible in a direction of a locked position.

14. An armament according to claim 1, wherein the armament is a hand grenade.

15. An armament according to claim 1, wherein the armament is an irritation body.

16. An armament comprising:

(a) an ignition housing;

(b) a rocker arm detonator provided with an ignition head and a rocker arm, wherein the rocker arm detonator is attached to the ignition housing; and (c) a safety mechanism integrated with the rocker arm detonator, wherein the safety mechanism facilitates re-securing of the rocker arm detonator after arming of the armament in order to arrest detonation of the armament, and wherein the safety mechanism comprises at least one profile component that is pivotably arranged on the ignition housing and that includes a safety cone that pivots with the at least one profile component to engage with the rocker arm of the armament, wherein the safety cone pivots with the at least one profile component to engage both the ignition head and the rocker arm, wherein the safety cone protrudes in an upward direction from the at least one profile component so that the safety cone is arranged in a first direction.

* * * * *